United States Patent [19]

Durchschlag et al.

[11] Patent Number: 4,982,919

[45] **Date of Patent: * Jan. 8, 1991**

[54] REVERSING DEVICE FOR MOVABLE PARTS OF A RAILWAY SWITCH

[75] Inventors: Gerald Durchschlag, Zeltweg; Alfred Lang, Wiesen, both of Austria

[73] Assignee: Voest-Alpine Maschinenbau Gesellschaft mbH, Linz, Austria

[ * ] Notice: The portion of the term of this patent subsequent to May 22, 2007 has been disclaimed.

[21] Appl. No.: 267,842

[22] Filed: Nov. 7, 1988

[30] Foreign Application Priority Data

Nov. 5, 1987 [AT] Austria ..... 2931/87

[51] Int. Cl.[5] ..... E01B 7/00; E01B 7/16

[52] U.S. Cl. ..... 246/382; 246/415 R; 246/435 R; 246/468

[58] Field of Search ..... 246/415 R, 435 R, 438, 246/442, 469, 382, 468, 392, 387, 391

[56] References Cited

U.S. PATENT DOCUMENTS

| | | | |
|---|---|---|---|
| 1,269,444 | 6/1918 | Hollingshed | 246/469 |
| 1,371,937 | 3/1921 | Scartsris | 246/435 X |
| 1,885,366 | 11/1932 | Martini | 246/415 R |
| 3,860,205 | 1/1975 | Dohse | 246/468 |
| 4,210,300 | 7/1980 | Kempa | 246/392 X |

FOREIGN PATENT DOCUMENTS

| | | | |
|---|---|---|---|
| 0970538 | 9/1958 | Fed. Rep. of Germany | 246/415 R |
| 328488 | 3/1976 | Fed. Rep. of Germany . | |
| 2529871 | 10/1976 | Fed. Rep. of Germany | 246/468 |
| 2245719 | 11/1979 | Fed. Rep. of Germany | 246/435 R |
| 3004406 | 8/1981 | Fed. Rep. of Germany | 246/442 |
| 0648060 | 10/1962 | Italy | 246/415 R |

*Primary Examiner*—Matthew C. Graham

*Attorney, Agent, or Firm*—Cushman, Darby & Cushman

[57] ABSTRACT

In a reversing device for the movable parts of a railway switch, in which movable wing rails are, in their end positions, alternately engaging the frog and are supported in their engaging positions by supporting rods extending in the longitudinal direction of the wing rails and which are slideably guided on the sleepers or, respectively, base plates, the supporting rods include at least one thrust support cooperating, for the purpose of shifting the wing rails relative to the frog, with thrust supports of the wing rails. In this case, at least one of the mutually cooperating surfaces of the thrust supports of a wing rail and/or supporting rod is formed of a wedge surface passing over into a supporting surface extending in essentially parallel relation to the longitudinal direction of the supporting rod. The supporting surface cooperates, in the position in which the wing rail contacts the frog, with the thrust support of the wing rail.

11 Claims, 10 Drawing Sheets

REVERSING DEVICE FOR MOVABLE PARTS OF A RAILWAY SWITCH

BACKGROUND OF THE INVENTION

1. Field of the Invention

The invention relates to a reversing device for the movable parts of a railway switch, in which movable wing rails are, in their end positions, alternately engaging the frog and are supported in their engaging position by supporting rods extending in the longitudinal direction of the wing rails and being slideably guided on the sleepers (i.e., ties) or, respectively, base plates in the longitudinal direction of the wing rails.

2. Description of the Prior Art

Railway switches for Vignole's rails comprising a frog and movable wing rails of the initially mentioned type have become known from AT-PS No. 328 488. The movable wing rails serve, in this case, the purpose of avoiding within the area of the frog tip any interruption of the travelling edge detracting from the travelling comfort, and there have become known more or less expensive constructions for supporting the wing rails in their position of just engaging the frog. In the construction for supporting the wing rails which has become known from AT-PS No. 328 488, switching operation of this switch was performed in a usual manner and a push rod extending in the shifting direction has been connected with the parts to be shifted. The supporting rods may extend over several sleepers and may thus provide a corresponding safety also in railway tracks being travelled upon with high speed.

From U.S. Pat. No. 1,269,444 there has become known a construction in which reversal of the switch is effected by means of wedges acting between rigid abutments on the sleepers and on the webs of the rails. In such constructions, the shifting drive means must articulatedly be linked to the wedges, because the wedges must be maintained in contact on the rail web. Exact guiding of the reversal devices is not easily possible in such a construction and, above all, a defined end position cannot easily be assured. In the known construction, the wedges must be swivelled together with the wing rails and on account of this swivelling movement there result, on account of the geometry of the link connection, variations of length within the drive connection and thus the known construction appears to not afford the required safety on railway tracks which are travelled upon with high speed.

SUMMARY OF THE INVENTION

The invention is now based on a construction of a reversal device for movable parts of a railway switch comprising movable wing rails of the initially mentioned type and aims at providing a simple adjustment of the wing rails, providing the possibility to obtain a high degree of safety and to correctly perform supporting as well as switching of the wing rails even in case of great temperature fluctuations. For solving this task, the construction according to the invention essentially consists in that the supporting rods comprise at least one thrust support cooperating with thrust supports of the wing rails for the purpose of shifting the wing rails relative to the frog. At least one of the mutually cooperating surfaces of the thrust supports of wing rail and/or supporting rod is formed of a wedge surface passing over into a supporting surface essentially parallelly extending relative to the longitudinal direction of the supporting rod and cooperating, in the position of the wing rail contacting the frog, with the thrust support of the wing rail. On account of supporting the supporting rods on the sleepers or, respectively, on base plates, exact guiding of these supporting rods is reliably obtained, and on account of arranging the thrust rods on the supporting rod or, respectively, on the wing rails, an exact adjustment of the wing rails may be obtained simultaneously with a shifting movement of the supporting rods for the purpose of securing the wing rails against horizontal forces. On account of the wedge surfaces for shifting the wing rails passing over into substantially parallel supporting surfaces, the adjustment path for adjusting wing rails is reliably defined even if there occur length variations, for example on account of temperature fluctuations. The essentially parallel supporting surfaces serve subsequently simultaneously for supporting the wing rails against occurring horizontal forces.

For the purpose of reducing the friction losses on the thrust supports, the arrangement may advantageously be such that one of both mutually cooperating thrust supports comprises a roller. The wedge surfaces themselves may be formed of plane wedge surfaces. It is, of course, easily conceiveable to design the wedge surfaces as arcuated surfaces, in particular as concavely arcuated surfaces.

According to the invention, the arrangement is advantagely such that each supporting rod and each wing rail comprises two thrust supports. In this manner it is possible to exactly shift by a defined amount and to bring in engagement with the frog even wing rails of greater length. The wing rails themselves may, in a usual manner, be interconnected by a hinged strut, so that shifting of one wing rail in the direction of contacting the frog simultaneously results in shifting the opposite wing rail until it arrives at a preselected distance from the frog. In principle, separate supporting rods may be provided for each movable wing rail. Driving must be effected in a phase-shifted manner such that for the purpose of shifting one wing rail in its position engaging the frog the other opposite wing rail to be lifted off the frog must first be released from its locked position.

According to the invention, the arrangement may, however, be selected in a simple manner such that thrust supports are arranged at both sides of the supporting rod and have their substantially parallel supporting surfaces extending in the longitudinal direction of the supporting rod staggered in longitudinal direction of the supporting rod. By means of such an arrangement, it becomes possible to simultaneously apply one movable wing rail onto the frog and to lift an opposite movable wing rail off the frog by means of only one supporting rod, for which purpose the arrangement may, for example, be selected in a particularly simple manner such that the thrust supports act on coupling members of mutually associated movable wing rails. The arrangement may, however, be selected such that the thrust supports connected with a supporting rod comprise cranked ledges transversely extending relative to the longitudinal axis of the supporting rod and cooperating with their flanks facing the thrust support and being averted from the thrust support with at least one counterstop each, in particular with a roller, of the thrust support of the wing rail. Also by means of such an arrangement it is possible to simultaneously effect by means of only one supporting rod the adjustment of two movable wing rails in such a manner, that one wing rail arrives in contact with the frog and the respective other wing rail just contacting the frog is lifted off the frog.

In addition to the substantially parallel supporting surfaces of the thrust support, there can be obtained a further supporting action between the thrust supports in a simple manner by arranging between thrust supports of a supporting rod and/or of a wing rail stops for supporting the wing rail in the position engaging the frog, which stops come out of engagement when shifting the supporting rods in their longitudinal direction, thereby freeing the shifting path of the wing rails.

In a preferred manner, the inventive procedure is such that the supporting rods are shiftably guided in angle sections which are connected with the sleepers or, respectively, base plates and extending in longitudinal direction of the wing rails. The arrangement is preferably such that the angle sections are connected with the base plates by welding. Such angle sections thus serve, beside for supporting and guiding the supporting rods, also for supporting the cross-section and for preventing any relative shifting movement in longitudinal direction between the frog tip and the wing rails. Stiffening of the frog area can be obtained in a particularly simple and favourable manner in particular in case of welding the wing rails.

For the purpose of reducing the sliding friction and keeping small the size of the drive means in case of long supporting rods, the arrangement is, according to the invention, advantageously selected such that the supporting rod or rods is (are) supported within the guide means via rollers in a sliding and/or resilient manner. Such a resilient supporting means makes sure that, in case of poorly packed tracks and thus in case of the upper edges of the sleepers being not in alignment, the supporting rods are reliably guided also over a great length.

On account of guiding the supporting rods on the sleepers or, respectively, base plates, the shifting forces may be introduced in a particularly simple and well defined manner into the supporting rods which simultaneously cause swivelling or, respectively, shifting of the wing rails. In a particularly simple manner, the supporting rods may, in this case, be connected with cylinder-piston-aggregates acting in the longitudinal direction of the supporting rods. The forces exerted for shifting the wing rails can exactly be introduced in the longitudinal direction of the supporting rods. This provides the possibility to provide in a simple manner safety means and control means directly on the cylinder-piston-aggregates or in proximity thereof, so that in case of maintainance work the drive means and the safety and control means can be checked in common.

A particularly simple drive means for adjusting the wing rails can be achieved if a common drive means, in particular a cylinder-piston-aggregate, is provided for both supporting rods. Such a common drive means can effect, via a coupling rod, shifting of the supporting rods in the same sense for adjusting the wing rails. In a particularly simple manner, the arrangement is, however, selected such that a drive means acts on at least one swivelably supported angle lever, noting that the free lever arm or arms is (are) articulatedly connected with the supporting rods. By means of such swivelably supported angle levers it is, in principle, possible to effect shifting movement of the supporting rods in the same sense or even in the opposite sense. The manner of the desired shifting movement of the supporting rods is dependent on the orientation and arrangement of the thrust supports. The articulated connection of the angle levers with the supporting rods can, in a simple manner, be formed of a slot or elongated hole and a bolt, of the respective other part, to be introduced into the slot or the elongated hole, thereby obtaining a high precision of the adjusting movement in a reliable manner and with particularly simple means. A particularly simple construction of high operating safety results if the arrangement is selected such that the angle lever is designed as a three-arm lever which is swivelable around an axis crossing the shifting direction of the supporting rods in normal direction, the central arm of said lever being connected with the drive means and the mutually opposite free arms of said lever being articulatedly connected with the supporting rods. Only a small space is required for arranging such angle levers. Such angle levers additionally afford a possibility being interesting for safety purposes, i.e. to achieve locking of the respective end positions. In this case, the drive means for the supporting rods may advantageously be formed of a push rod which is engaged via a bolt or pin in one swivelable lever for shifting the supporting rods, and flanks or, respectively, recesses extending, in the respective end positions of the swiveling movement, in essentially parallel relation to the shifting direction of the push rod can be adjoined to the recess or, respectively, elongated slot of the swivelable lever.

The safety and control means required for checking the position may, in a simple manner, be designed such that the supporting rods are connected with means for sensing the position of the supporting rods, such as, electromagnetic transmitters for the end position.

BRIEF DESCRIPTION OF THE DRAWINGS

In the following, the invention is further explained with reference to examples of embodiment schematically shown in the drawings.

In the drawings

DETAILED DESCRIPTION OF THE PREFERRED EMBODIMENTS

Figure 1:
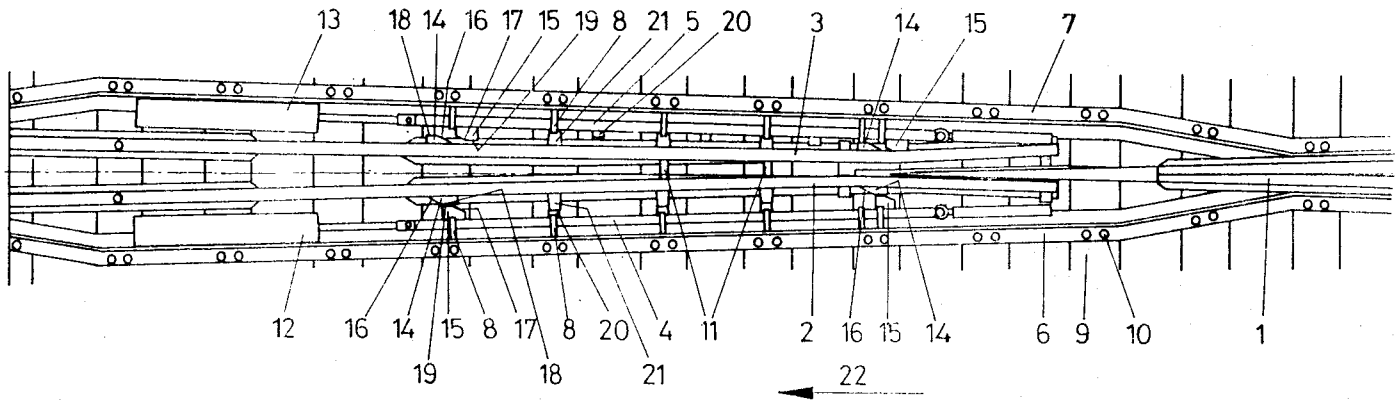
FIG. 1 shows a frog with movable wing rails according to the invention.

In FIG. 1, there is shown a frog 1 which is alternately contacted by wing rails 2 and 3 in their end positions. Supporting and shifting of the wing rails 2 and 3 is effected via supporting rods 4 and 5 extending in the longitudinal direction of the wing rails and being guided, according to the representation of FIG. 1, within guides 8 of metal sections 6 and 7. The sections 6 and 7 are mounted by means of screws 10 on locations, schematically designated by the reference numeral 9, of the sleepers. In place of a screw connection of the angle sections 6, 7, these sections may also be connected with the base plates by welding, noting that in place of the base plates there can, if desired, be used a continuous sliding plate comprising recesses in the sleeper compartments. The sections welded with such base plates are connected by means of screws at the ends with the fixedly mounted rails via spacers. In place of the sections 6 and 7 shown, there can be provided a guide means for the supporting rods of the type that guide means corresponding to the guide means 8 are directly mounted on the sleepers or, respectively, base plates (generically, on a fixed based means). The angle sections 6 and 7 serve, beside for guiding and supporting the supporting rods, simultaneously for supporting the cross-section and for preventing any relative shifting movement between the frog tip 1 and the wing rails 2 and 3 in the longitudinal direction. Furthermore, the sections 6 and 7 result in stiffening the frog area and resist the horizontal forces exerted when the wing rails 2 and 3 are travelled upon. The wing rails 2 and 3 are connected one with the other via articulated supports 11 for keeping free the passage groove and for maintaining a defined distance between the wing rails.

Cylinder-piston-aggregates are provided for shifting the supporting rods 4 and 5 and form the drive means 12 and 13. In the representation according to FIG. 1, the wing rail 2 contacts the frog 1 and is supported in its frog-contacting position by means of thrust supports 14 on the wing rail and by means of thrust supports 15 on the supporting rod. The thrust supports 14 each comprise wedge surfaces 16 and the thrust supports 15 comprise wedge surfaces 17, which wedge surfaces pass over in a supporting surface 18 and, respectively, 19, extending in the longitudinal direction of the supporting rod. Different embodiments of such thrust supports 14 and 15 are shown in greater detail in FIGS. 2 to 4. Between the thrust supports 15 of a supporting rod and the thrust supports 14 of the respective associated wing rail there are provided further stop members 20 on the supporting rods 4, 5 and further stop members 21 on the wing rails 2, 3. The arrangement of these additional stop members 20 and 21, respectively, is selected such that, on occasion of shifting a supporting rod, the stop members 20 and 21 are disengaged for freeing the wing rails, as this is shown in FIG. 1 for the wing rail 3 and the supporting rod 5, respectively.

In the embodiment shown in FIG. 1, reversal of the wing rails is effected such that both drive means 12 and 13 move in the same direction during the reversing operation. In principle, that drive means shall start operation at first which keeps the wing rail locked. However, in case of a suitable arrangement of the thrust supports 14 and 15, respectively, as well as of the additional stop members 20 and 21, respectively, both drive means may simultaneously perform the reversing movement. If the drive means are simultaneously actuated, provision must reliably be made that at first the wing rail contacting the frog 1 is released and only then the other wing rail is reversed via the thrust supports 14 and 15, because the wing rails 2 and 3 can only be moved in common on account of being interconnected via the articulated supports 11.

In the representation according to FIG. 1, the drive means 12 moves the supporting rod 4 in direction of the arrow 22 for the purpose of releasing the wing rail 2, whereby the thrust supports 14 and 15 and the stop members 20 and 21 are disengaged and the wing rail 2 is thus released. Simultaneously, adjustment of the supporting rod 5 in the direction 22 causes the wedge surfaces 16 and 17 of the thrust supports 14 and 15 to run up one on the other and the wing rail 3 to be reversed in direction to the frog tip. The defined end position is assumed and the wing rail 3 is engaged on the frog 1 as soon as the supporting surfaces 18 and 19, respectively, of the thrust supports 14 and 15, which supporting surfaces extend essentially in parallel relation to the longitudinal direction of the supporting rods, contact one another. In this position, there cooperate one with the other also the stop members 20 and 21 which thus provide a reliable support for the wing rails. On account of the articulated joints 11 between the wing rails 2 and 3, the wing rail 2 has been moved away from the frog 1 during this reversal procedure. The respective end positions of the wing rails 2 and 3 and of the supporting rods and, respectively, of the drive means are, in this case, electro-mechanically monitored, which is, however, not shown in FIG. 1 for sake of clarity.

Figure 2:
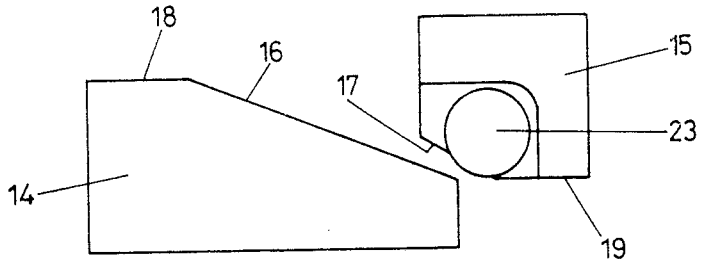
FIGS. 2, 3, and 4 show in an enlarged scale two mutually cooperating thrust supports of a wing rail and of a supporting rod according to the invention.
Figure 3:
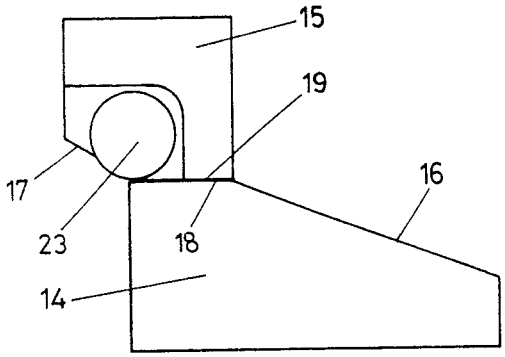
Figure 4:
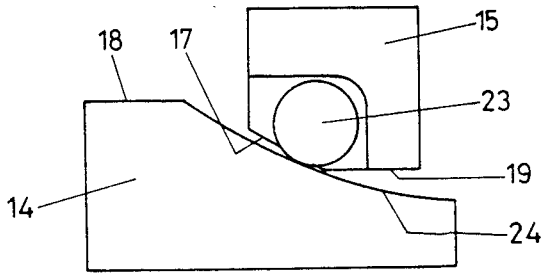

In FIGS. 2 to 4, there are shown in an enlarged scale various embodiments of thrust supports 14 and 15, respectively. The thrust support 14 of a wing rail (not shown) has an inclined wedge surface 16 and a supporting surface 18 extending essentially in the longitudinal direction of the supporting rod and of the wing rail. The thrust support 15 of a supporting rod (not shown) has a wedge surface 17 as well as a supporting surface 18 likewise extending essentially parallelly to the longitudinal direction of the supporting rod. In the representation according to FIG. 2, there is shown the opened position, i.e. a position between wing rail and supporting rod as shown in FIG. 1 for the rail 3 and the supporting rod 5. For the purpose of reducing friction losses at the thrust supports 14 and, respectively, 15, the thrust support 15 comprises a roller 23. The supporting action on the thrust support 14 is exerted on a surface extending in a direction which is normal to the direction of the acting force and this for the purpose of avoiding any force component acting in the longitudinal direction of the respective supporting rod. In the representation according to FIG. 3, the wing rail assumes a closed position, which means that the supporting surfaces 18, 19 extending in the longitudinal direction of the supporting rod provide a defined supporting action for the wing rail. FIG. 3 corresponds to an enlarged representation of the thrust supports 14 and 15 of the wing rail 2 in the representation according to FIG. 1. In the representation according to FIG. 4, the thrust support 15 of the supporting rod comprises again a roller 23, which, however, runs up on a concavely curved surface 24 in this embodiment.

Figure 5:
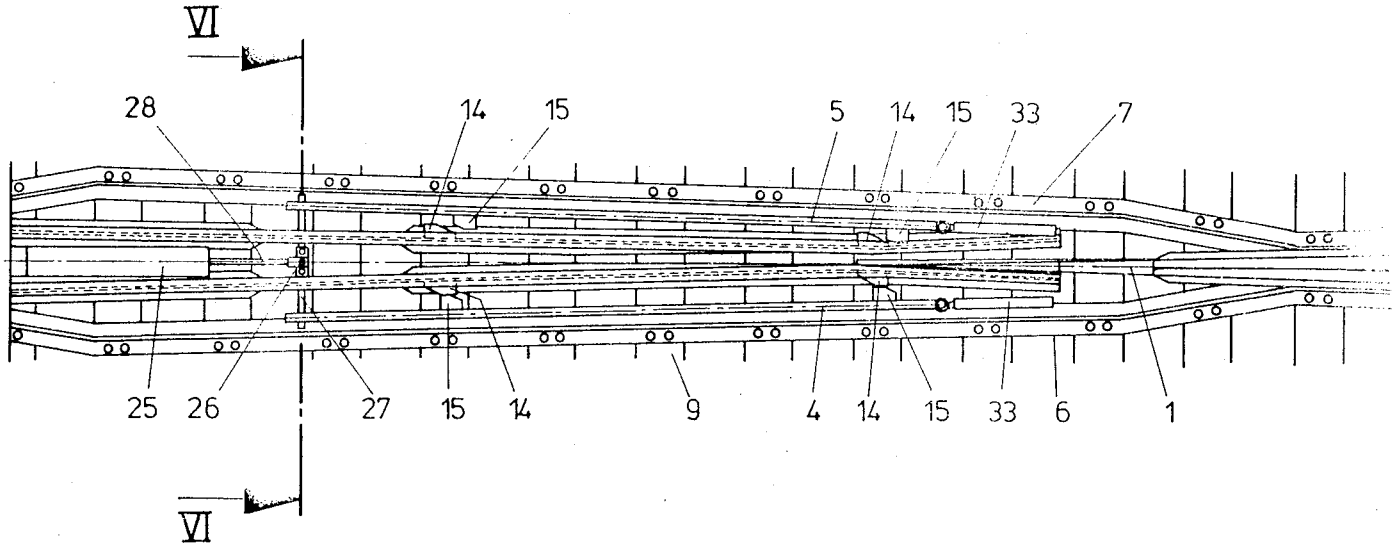
FIG. 5 shows in a top plan view analogous to that of FIG. 1 a frog according to the invention, a common drive means being provided for the supporting rods which are shiftable in the longitudinal direction of the wing rails.

In the representation according to FIG. 5, the reference numerals of FIG. 1 are maintained. For sake of clarity, the additional stop members 20 and 21 arranged between the respective two thrust supports 14 and 15, respectively, of each wing rail 2, 3 and each supporting rod 4 and 5 are omitted from FIG. 5. In contrast to the representation according to FIG. 1, a common drive means 25 for the supporting rods 4 and 5 is provided in the embodiment according to FIG. 5. This drive means 25 acts, at 26, on a rigid coupling rod 27 interconnecting two supporting rods 4,5, as is more exactly shown in FIG. 6.

Figure 6:
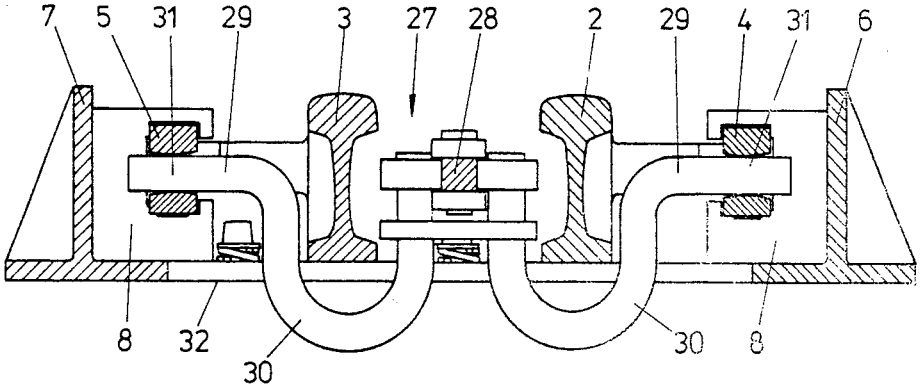
FIG. 6 shows a section along VI—VI of FIG. 5.

From the sectional view of FIG. 6 there can be understood how the push rod 28 of the common drive means 25 acts on the coupling rod 27. In this embodiment, this coupling rod 27 is formed of two U-shaped coupling elements 30 which are provided with a flange 29 and connected with the supporting rods 4 and, respectively, 5 at 31. In the representation according to FIG. 6, there is also shown in detail the guide means 8, provided in the metal section 6 and 7, for the supporting rods 4 and 5, respectively. The coupling elements 30 extend in this embodiment below the wing rails 2 and 3 and through base plates 32 for the wing rails and result in rigidly coupling the push rod 28 with the supporting rods 4 and 5. In this embodiment, there is indicated a welding connection between the base plates and the metal sections. In this case, the supporting rods 4 and 5 are monitored by means of electro-mechanical circuit elements 33 (FIG. 5) at the end located opposite the drive means. Such an arrangement is also provided in the embodiment according to FIG. 1.

Figure 7:
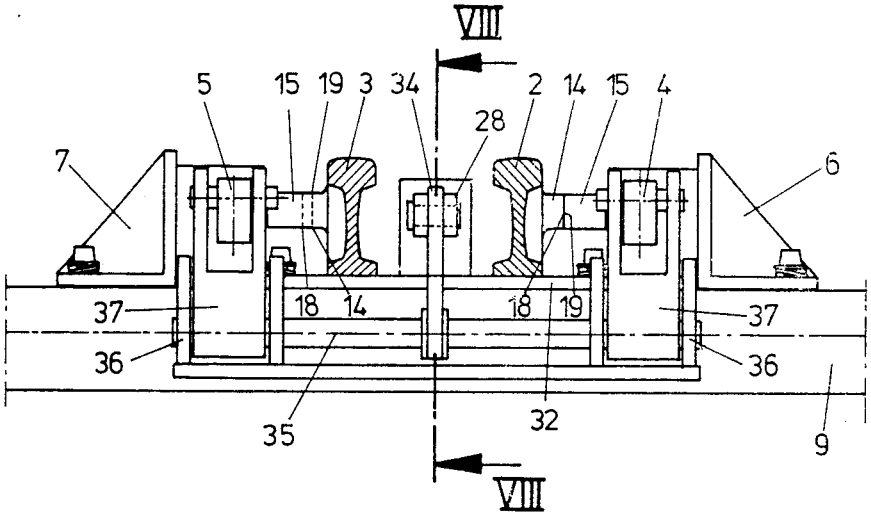
FIG. 7 shows a view analogous to that of FIG. 6, but in which the common drive means is articulatedly connected with the supporting rods via angle levers.

In the embodiment according to FIG. 7, shifting of the supporting rods 4 and 5 is, when using a common drive means (25), effected by angle levers. In this embodiment, the push rod 28 cooperating with the common drive means embraces an angle lever 34 which is rotatable for being swiveled around an axis 35. The axis 35 is supported in bearings 36 which are rigidly connected with the base plate 32 or with the sleepers 9. Further lever angles 37 are positively connected with the axis 35 for rotation so that, when moving the angle lever 34, the supporting rods 4 and 5 cooperating with the angle lever 37 are equally moved. In the representation according to FIG. 7, the supporting surfaces 18 and 19 of the thrust supports 14, 15, which supporting surfaces 18, 19 extend in parallel relation to the longitudinal direction of the supporting rod 4, contact one another as is in correspondence with the position of the wing rail 2 shown in FIG. 1, while the thrust supports 14 and 15 of the wing rail 3 and, respectively, of the supporting rod 5 are staggered one against the other in the longitudinal direction as is indicated by the parallel supporting surfaces 18 and 19 shown in dashed lines and arranged in a staggered manner.

Figure 8:
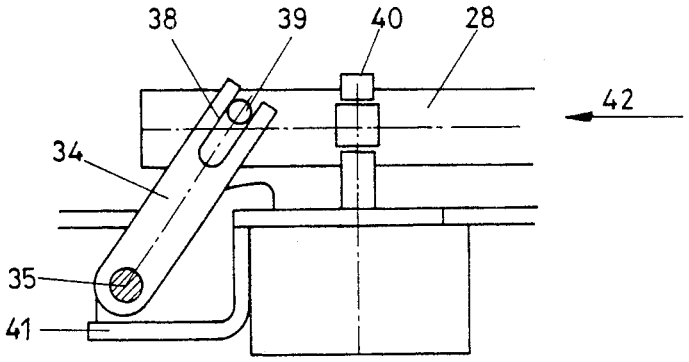
FIGS. 8, 9 and 10 show in an enlarged scale a section along line VIII—VIII of FIG. 7 of various embodiments of an angle lever.
Figure 9:
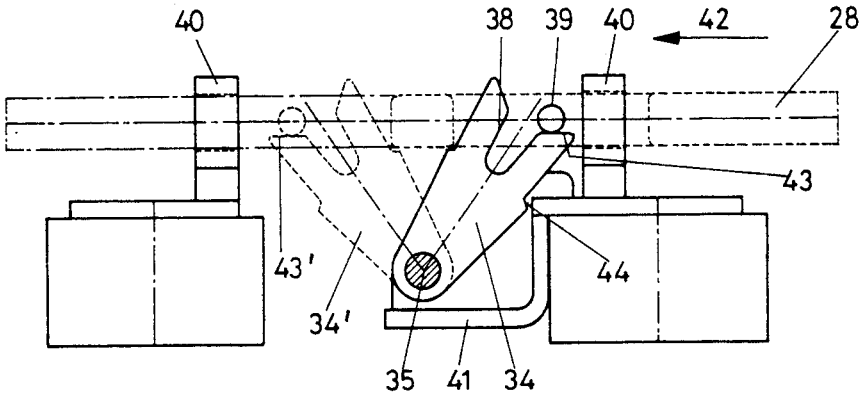
Figure 10:
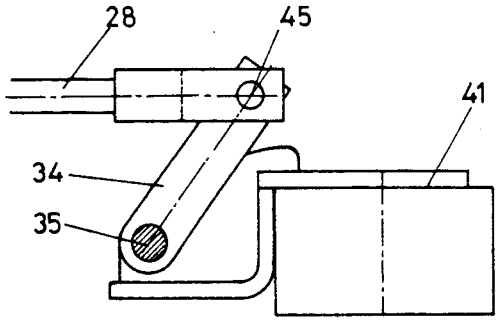

In the FIGS. 8 to 10, there are shown different arrangements for transmitting the shifting movement of the push rod 28 of a common drive means on the central angle lever 34 and thus on the angle levers 37 cooperating with the supporting rods 4 and 5. In the representation according to FIG. 8, the angle lever 34 has an elongated slot 38 which is engaged by a bolt 39 of the push rod 28. In this case, the push rod 28 is additionally supported within a bearing 40. In addition to the representation according to FIG. 7, the common shaft 35 for transmitting the rotating movement of the lever 34 onto the levers 37 is supported in a further bearing 41 within the area of the lever 34. In FIG. 8 there is shown one end position of the push rod 28. When shifting the push rod 28 in the direction of the arrow 42, the angle lever 34 is taken along by means of the bolt 39, said angle lever 34 causing movement of the supporting rods 4 and 5 in the same sense via the axis 35 and via the angle lever 37.

In the embodiment shown in FIG. 9, there are provided two bearings 40 for the push rod 28 of the common drive means and the central angle lever 34 has again a slot 38 which is engaged by a bolt 39 for moving this lever 34 around the axis 35 rigidly connected therewith. Deviating from the arrangement according to FIG. 8, flanks 43 extending in one respective end position of the angle lever 34 in parallel relation to the shifting direction 42 and to the longitudinal direction of the push rod 28 adjoin the slot 38 of the central angle lever 34. Such flanks 43 make possible, in a simple . manner, a lock required for safety purposes and, respectively, a limitation of the shifting path of the angle lever 34 and thus of the angle levers 37 cooperating with the supporting rods 4 and 5. As soon as the bolt 39 arrives in the area of the flank 43, the angle lever 34 is no more taken along by the bolt 39 of the push rod 28, so that the angle lever 34 is not further rotated about the axis 35 even when the push rod is further moved. Likewise, the angle lever 34 is, when moving the push rod in direction of the arrow 42 into the position 34' shown in dashed lines, taken along by the bolt 39 only as long as this bolt is located within the area of the elongated slot 38, while movement of the angle lever 34 is terminated when arriving at the flank 43'. In addition to this safety protection by such flanks 43 extending in essentially parallel relation to the longitudinal direction of the push rod 28, also a stop member 44 cooperating with the push rod 28 can be provided on the angle lever 34.

In the representation according to FIG. 10, rotation of the angle lever 34 around the shaft 35 is effected by articulatedly supporting the push rod 28 on an axis 45. Provision must be made in this embodiment that the common drive means 25 is equally articulatedly supported at its end located opposite the bearing location 45 and this for the purpose to be in the position to compensate level differences caused on account of differing angle position of the angle lever 34.

Figure 11:
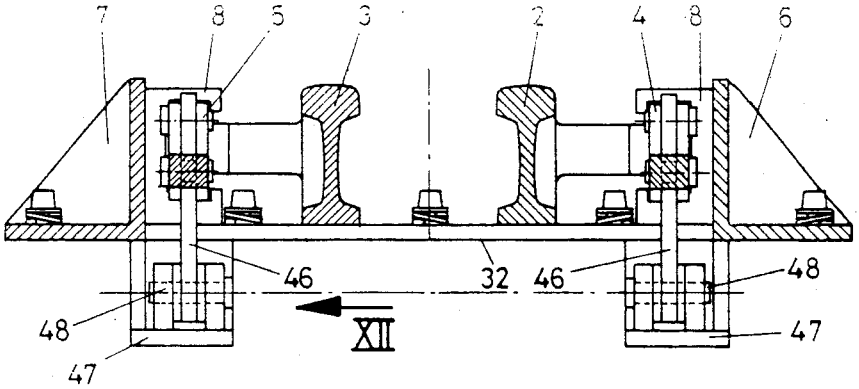
FIG. 11 shows a view analogous to FIGS. 6 and 7, but in which separate drive means acting via angle levers are provided for the supporting rods.
Figure 12:
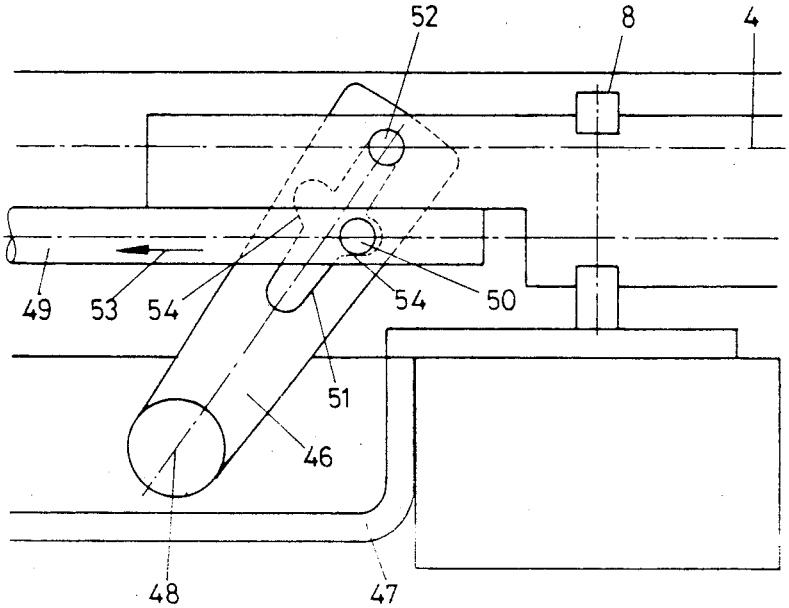
FIG. 12 shows a view in direction of the arrow XII of FIG. 11, the mounting for the supporting rod being not shown.

In the representation according to FIG. 11, shifting of the supporting rods 4 and 5, respectively, is again effected by means of angle levers. In this embodiment, a separate drive means is provided for each supporting rod. In this case, a respective one angle lever 46 is swivelable around an axis 48 supported within a bearing 47. Adjustment of the supporting rod 4 and 5, respectively, is more fully explained in FIG. 12. A push rod 49 of one drive means has again a bolt 50 engaging a recess 51 of the lever 46. The supporting rod 4 has a bolt 52 equally engaging the recess 51. When shifting the push rod 49 in direction of the arrow 53, the lever 46 is taken along by the bolt 50. The recess 51 essentially designed as an elongated slot and extending in longitudinal direction of the lever has, for the purpose of securing the end position and for providing a lock, flanks 54 extending in the end positions of the supporting rod 4 in essentially parallel relation to the shifting direction 53 of the push rod 49.

Figure 13:
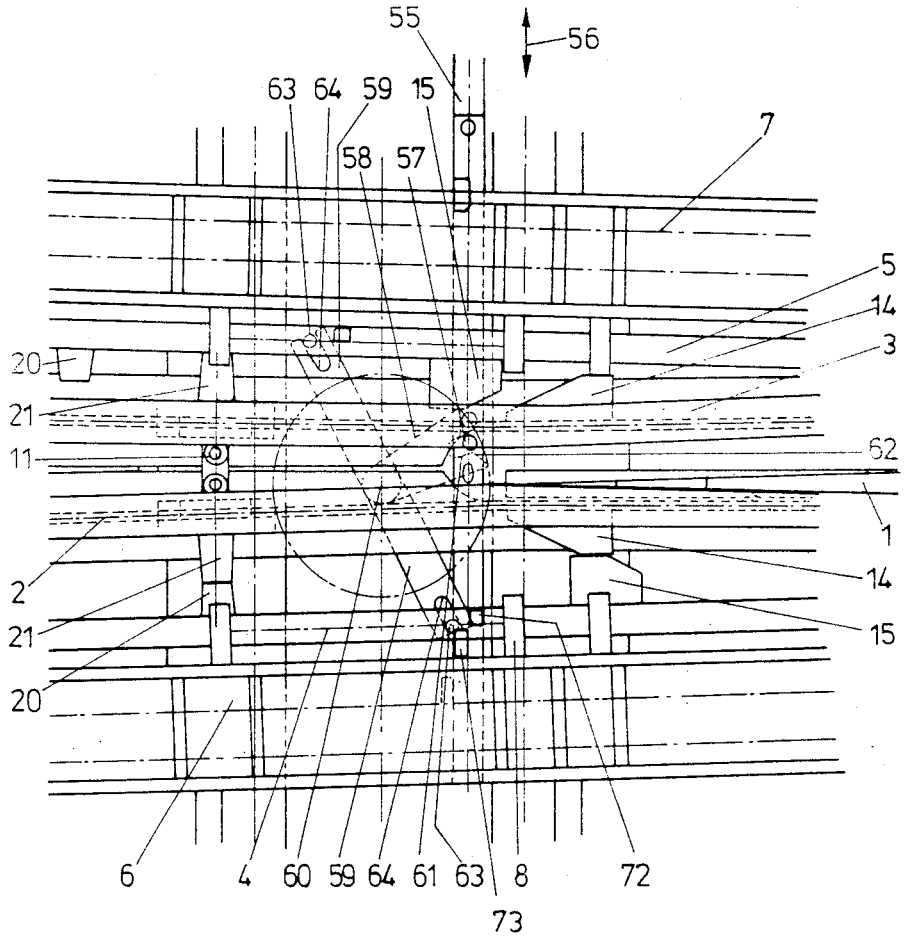
FIG. 13 shows in a greatly enlarged scale and similar to FIG. 1 a top plan view of the inventive frog together with movable wing rails and with a further embodiment of a drive means for the supporting rods.

In the representation according to FIG. 13, there is shown a further embodiment of a drive means for the supporting rods 4 and 5, respectively. In this embodiment, the drive means is formed of a push rod 55 extending substantially in direction normal to the longitudinal direction of the wing rails and which is movable in the direction of the twin-arrow 56. In this embodiment, the whole drive means can be arranged below the base plate. The push rod 55 is engaged via a bolt 57 in an angle lever 58 which is rigidly connected with angle levers 59 and rotatably supported for rotation around an axis designated by the reference numeral 60. The angle lever 58 has an elongated slot 61 with chamferred flanks 62. The operation of this angle lever 58 is analogous to the operation of the angle lever shown in FIG. 9. The supporting rods 4 and 5, respectively, of the push rod 55 have stop members 72 and 73, respectively, which are arranged such that they prevent any unacceptable movement of the supporting rods, said stop members thus serving as additional safety elements. The supporting rods 4 and 5 comprise bolts 63 engaging elongated slots 64 of the angle levers 59. When moving the push rod 55 in direction of the arrow 56, the angle levers 59 are taken along via the angle lever 58 and are thus rotated. This rotation of the angle levers 59 is, via the bolts 63, transformed into an opposite translational motion of the supporting rods 4 and 5, respectively. Adjustment and supporting of the wing rails 2 and 3 is, when shifting the supporting rods 4 and 5, effected via the thrust supports 14 and 15 as has already been explained in detail.

Figure 14:
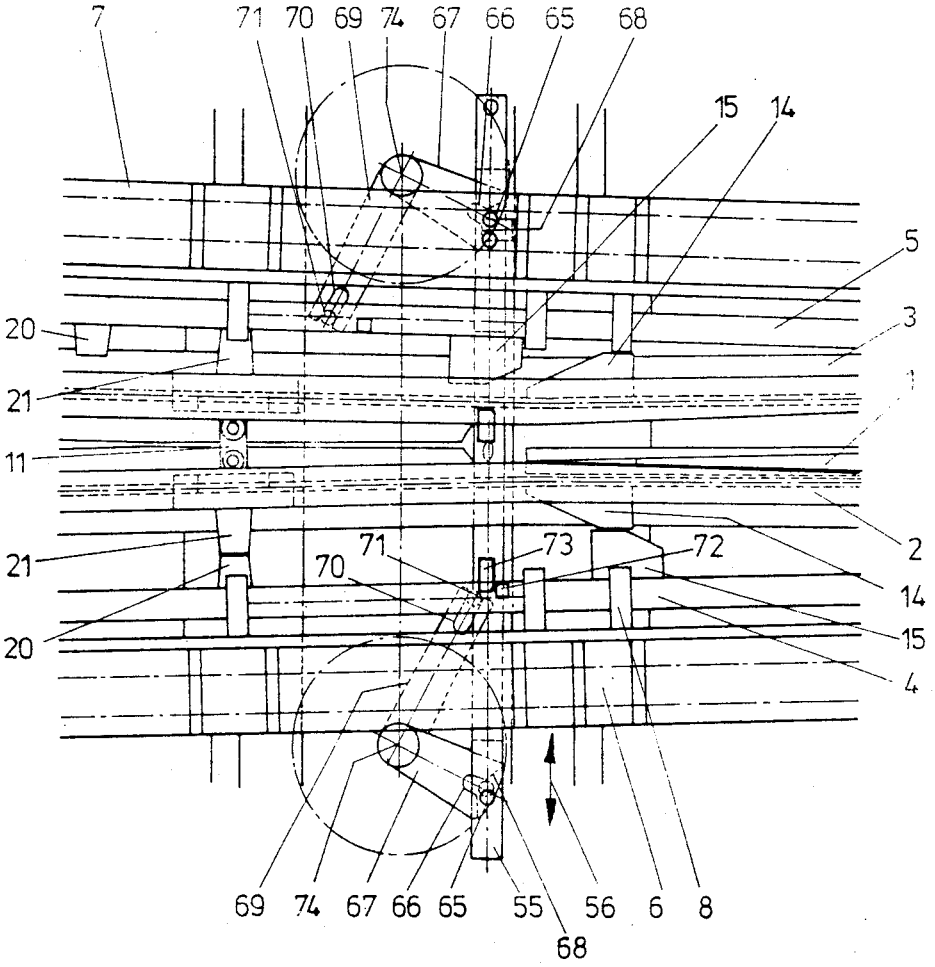
FIG. 14 shows a view analogous to that of FIG. 13 together with a further modified embodiment.

In the representation according to FIG. 14, the driving action is again exerted by a Push rod 55 extending essentially in a direction normal to the longitudinal direction of the wing rails 2, 3. In this embodiment, the push rod 55 has two bolts 65 engaging elongated slots 66 of two angle levers 67. The angle levers are, as in the representation according to FIG. 13, again provided with chamferred flanks 68. The angle levers 67 are rigidly connected with angle levers 69 for rotation around an axis 74, said angle levers 69 comprising at their free end an elongated slot 70 which is engaged by a bolt 71 of the corresponding supporting rod 4 and 5, respectively. When shifting the push rod 55 in direction of the arrow 56, the angle levers 69 are rotated via the angle levers 67. This rotating movement is, via these bolts 71, transformed into a respective translational motion of the supporting rods 4 and 5. The supporting rods 4 and 5 and the push rod 55 comprise stop members 72 and, respectively, 73 which are arranged such that they prevent any unacceptable movement of the supporting rods and thus serve as additional safety elements. When reversing the wing rails, the manner of operation is exerted via the thrust supports 14 and 15 as has already been explained in detail in the description of FIG. 1.

Figure 15:
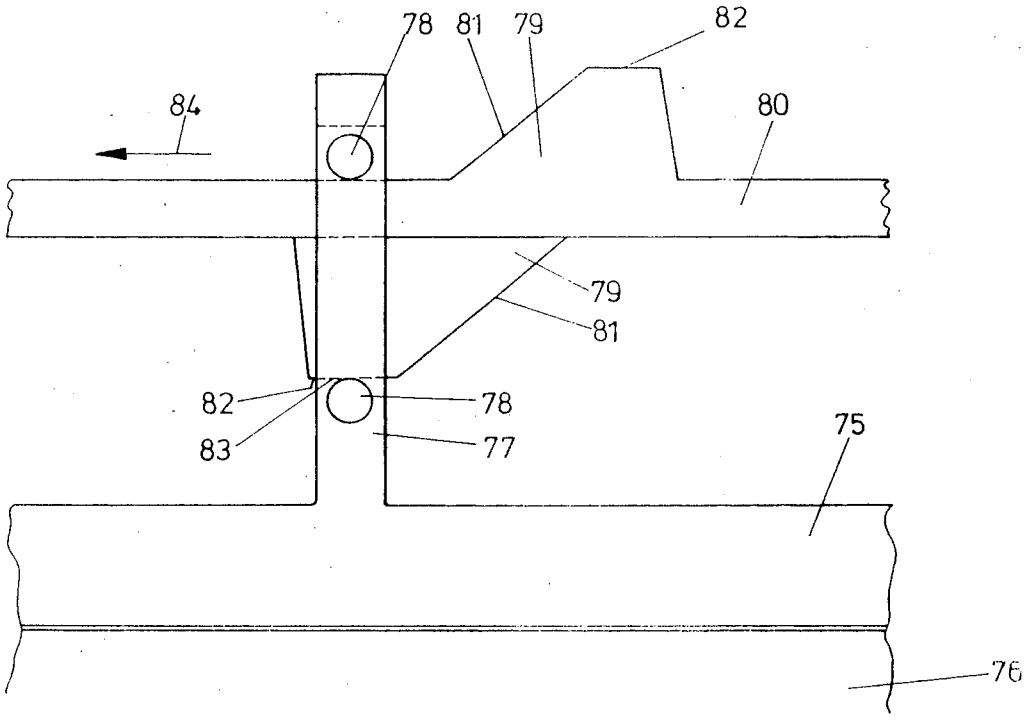
FIG. 15 shows in an enlarged scale a first embodiment of a supporting rod together with thrust supports arranged at both sides.

In FIG. 15, there is shown on an enlarged scale a movable wing rail 75 contacting a frog 76. A thrust support 77 is connected with the wing rail 75 and has bearingly supported therein rollers 78 cooperating with thrust supports 79 of a supporting rod 80 which is movable only in the longitudinal direction of the rail. The thrust supports 79 comprise again inclined wedge surfaces 81 as well as supporting surfaces 82 extending in essentially parallel relation to the longitudinal direction of the supporting rod 80. In the position shown in FIG. 15, locking of the wing rail is effected by the cooperation of the supporting surfaces 82 facing the rail with a stop surface 83 provided within the plane of the roller 87. For the purpose of opening or, respectively, reversing the wing rail, the mutually contacting surfaces 82 and 83 are, when moving the supporting rod 80 in direction of the arrow 84, first disengaged, whereupon the roller 78 located at a greater distance from the wing rail 75 subsequently comes into engagement with the outwardly located wedge surface 81 and thus lifts the wing rail 75 off the frog 76. For the purpose of supporting the wing rail 75 over its whole length, there can be arranged, in analogism to the previous figures, several thrust supports in longitudinal direction on the supporting rod 80. In such an embodiment comprising a twin-arrangement of thrust supports, coupling of the wing rails by means of articulated struts may be omitted, because not only a reversal operation and locking operation is effected via the thrust supports, but also opening of the corresponding wing rail is effected by the thrust support arranged on the other side of the supporting rod. In case of a supporting rod of corresponding stability and in case of a correspondingly powerful drive means, a supporting rod comprising thrust supports 79 at both of its sides may also cooperate with a connecting rod or, respectively, articulated strut between the wing rails, so that one can do with one single supporting rod for reversing both wing rails.

Figure 16:
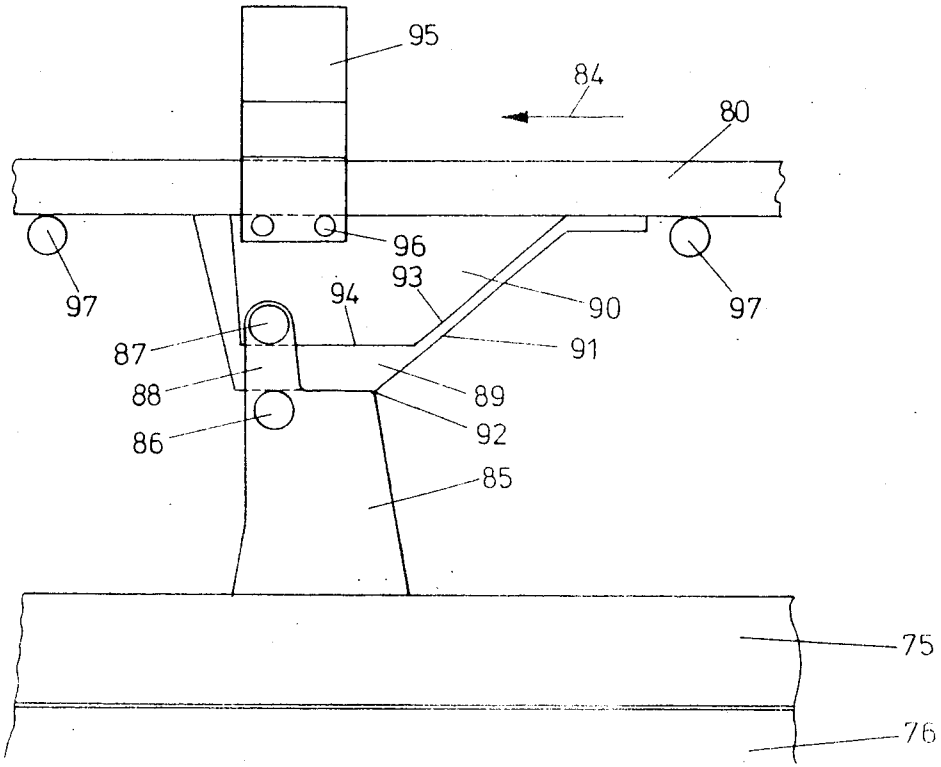
FIG. 16 shows in an illustration analogous to that of FIG. 15 an other embodiment of a twin-arrangement of thrust supports.

In the arrangement according to FIG. 16, the wing rail 75 is again shown in its position contacting the frog 76 and is connected with a thrust support 85. The thrust support 85 has rollers 86 and 87 which are bearingly supported within a protrusion 88 of the thrust support 85 and embracing a ledge 89 connected with a thrust support 90, in turn connected with the supporting rod 80. The ledge 89, for example extending outward of the plane of the supporting rod 80, comprises a first wedge surface 91 passing over into a first supporting surface 92 extending in essentially parallel relation to the longitudinal direction of the supporting rod 80 and cooperating with the roller 86 and comprises a second wedge surface or inclined surface 93, respectively, passing over into a second supporting surface 94. When moving the supporting rod 80 in direction of the arrow 84 for the purpose of opening or, respectively, reversing the wing rail 75, the roller 86 is first disengaged from the supporting surface 92, whereupon the wing rail 75 is lifted off the frog 76 on account of a cooperation of the roller 87 with the second wedge surface 93 of the ledge. For the purpose of guiding the supporting rod 80, there is indicated a guide means 95 which is connected with sleepers (not shown in detail) and comprising guide rollers 96 for providing frictionless sliding movement of the supporting rod 80. Further guide rollers 97 for improving the guiding effect are indicated. In the shown embodiment of a supporting rod comprising thrust supports, one can in analogism to the embodiment according to FIG. 15, omit connecting rods or articulated struts, respectively, between the wing rails if such thrust supports are associated with each wing rail. One can, however, also do with one single supporting rod of this type for reversing the switch if a connection between both wing rails is provided and the supporting rod acts in case of a sufficiently powerful drive means on this articulated strut or connecting rod.

What is claimed is:

1. In a railway switch which includes a frog and two wing rails having respective end portions which are generally transversally movable into alternative longitudinally overlapping close juxtaposition with the frog for providing with the frog two alternative longitudinal railroad paths, and a fixed base on which said frog and said two wing rails are supported, a reversing device, comprising:

a respective supporting rod for each said wing rail end portion, each said supporting rod being supported on said fixed base and disposed generally beside the respective wing rail portion, for essentially reciprocal movement generally longitudinally of the respective wing rail end portion between an inactive position and an active position;

means for longitudinally reciprocating each supporting rod between said inactive and active positions thereof;

each wing rail end portion and each supporting rod having mounted thereto at least one thrust support arranged to act generally transfersally of the respective said railway path, each supporting rod thrust support, upon longitudinal movement of the respective supporting rod from said inactive position thereof to said active position thereof, being arranged to engage a respective said thrust support of a respective said wing rail end portion for generally transversally shifting such wing rail end portion into longitudinally overlapping close juxtaposition with said frog;

each supporting rod thrust support and wing rail end portion thrust support which are arranged to engage one another each comprising a supporting surface which faces transversally of the respective said longitudinally railway path and extends substantially parallel to the respective said supporting rod when such supporting rod is in said active position thereof, these supporting surfaces forming a respective pair which are engaged in surface-to-surface engagement when the respective said supporting rod is in said active position;

at least one of the supporting rod thrust support and wing rail end portion thrust support which has each said respective pair of supporting surfaces, and thus constitutes a pair of thrust supports, also having a wedge surface leading to the respective said supporting surface, each said wedge supporting surface being so oriented that, as the respective supporting rod is longitudinally moved from said inactive position thereof towards said active position thereof, as the respective said thrust supports begin to engage, each respective said wedge surface of one member of the respective pair of thrust support prior to surface-to-surface engagement being established between the respective said pair of supporting surface, whereby each said wedge surface facilitates establishment of such surface-to surface engagement.

2. The reversing device of claim 1, wherein:

within each said pair of thrust supports, one said thrust support has said wedge surface, and the other said thrust support has a roller supported for rotation adjacent the respective said supporting surface of said other said thrust support for providing said correspondingly leading portion of said other thrust support.

3. The reversing device of claim 1, wherein:

each said wing rail end portion and each said supporting rod has at least two said thrust supports mounted thereto and axially spaced from one another longitudinally of the respective said railway path.

4. The reversing device of claim 1, further comprising:

each wing rail end portion and each supporting rod having mounted thereto at least one stop arranged to act generally transverally of the respective railway path, each supporting rod stop, upon longitudinal movement of the respective supporting rod from said inactive position thereof to said active position thereof, being arranged to engage a respective said stop of a respective said wing rail end portion for assisting in maintaining such wing rail end portion shifted into longitudinally overlapping close juxtaposition with said frog;

on each respective wing rail end portion and supporting rod each said at least one thrust support and each said at least one stop being axially spaced form one another longitudinally of the respective said railway path.

5. The reversing device of claim 1, wherein:

said fixed base comprises a series of sleepers, and said supporting rods are supported on said sleepers by means of angle sections mounted on at least some of said sleepers.

6. The reversing device of claim 1, wherein:

said fixed base comprises a series of base plates, and said supporting rods are supported on said base plates by means of angle sections welded to at least some of said base plates.

7. The reversing device of claim 1, wherein:

said supporting rods are supported on said fixed base by means of guides mounted on said fixed base and having rollers disposed in rolling contact with said supporting rods.

8. The reversing device of claim 1, wherein:

said means for longitudinally reciprocating each supporting rod comprises at least one longitudinally-acting expansible-contractible cylinder-piston aggregate and means for effectively connecting each such aggregate between said fixed base and at least one said supporting rod.

9. The reversing device of claim 8, wherein:

said means for effectively connecting said aggregate between said fixed base and at least one said supporting rod, effectively connects one said aggregate between said fixed base and both of said supporting rods.

10. The reversing device of claim 9, wherein:

said means for effectively connecting said aggregate between said fixed base and both said supporting rods in generally the same one longitudinal direction when said aggregate is expanded from a contracted condition, and moves both of said supporting rods in generally the same opposite longitudinal direction when said aggregate is contracted from an expanded condition.

11. The reversing device of claim 9, wherein:

said means for effectively connecting said aggregate between said fixed base and both said supporting rods moves said supporting rods in generally opposite longitudinal directions relative to one another when said aggregate is expanded from a contracted condition, and moves both of said supporting rods in generally opposite directions relative to one another when said aggregate is contracted from an expanded condition.

* * * * *